US009422681B2

(12) United States Patent
Smith

(10) Patent No.: US 9,422,681 B2
(45) Date of Patent: Aug. 23, 2016

(54) INTERLOCKING HIGHWAY BARRIER STRUCTURE

(71) Applicant: EASI-SET INDUSTRIES, INC., Midland, VA (US)

(72) Inventor: Rodney I. Smith, Midland, VA (US)

(73) Assignee: Easi-Set Industries, Inc., Midland, VA (US)

( * ) Notice: Subject to any disclaimer, the term of this patent is extended or adjusted under 35 U.S.C. 154(b) by 0 days.

(21) Appl. No.: 14/424,684

(22) PCT Filed: Aug. 29, 2013

(86) PCT No.: PCT/US2013/057250

§ 371 (c)(1),
(2) Date: Feb. 27, 2015

(87) PCT Pub. No.: WO2014/036237

PCT Pub. Date: Mar. 6, 2014

(65) Prior Publication Data

US 2015/0218763 A1 Aug. 6, 2015

Related U.S. Application Data

(60) Provisional application No. 61/696,144, filed on Sep. 1, 2012.

(51) Int. Cl.
*E01F 15/08* (2006.01)

(52) U.S. Cl.
CPC ..... *E01F 15/088* (2013.01); *E01F 15/08* (2013.01); *E01F 15/083* (2013.01)

(58) Field of Classification Search
CPC ..... E01F 15/02; E01F 15/04; E01F 15/08; E01F 15/088; E01F 15/083; E01D 19/00; E01D 19/10
USPC ..... 404/6; 256/13.1
See application file for complete search history.

(56) References Cited

U.S. PATENT DOCUMENTS 4,105,353 A * 8/1978 Bork ..... E01C 11/223 404/2
4,946,306 A * 8/1990 Yodock ..... E01F 15/086 256/13.1
5,149,224 A * 9/1992 Smith ..... E01F 15/088 256/13.1
5,218,805 A * 6/1993 Rex ..... E02D 27/42 256/24

(Continued)

FOREIGN PATENT DOCUMENTS

WO 2004/111362 A1 12/2004

*Primary Examiner* — Abigail A Risic
(74) *Attorney, Agent, or Firm* — Whitham, Curtis & Cook, P.C.

(57) ABSTRACT

A barrier structure with bolt-down pockets, allowing the structure to be installed as a semi-permanent or permanent structure. The bolt-down pockets are at uniform spacing along the base of the barrier structure and located on opposite sides of the structure. A bolt-down bar extends across and through the base at each pair of bolt-down pockets. Additional reinforcement is provided by rebar bent a generally "U" shape, sometimes called a "hairpin" shape. Toward each end of each bolt-down plate, the base of the "U" shaped rebar is welded to the bolt-down plate near a bolt hole in the bolt-down plate with the legs of the "U" extending at an angle up into the concrete structure. Further reinforcing at the sites of the bolt-down pockets is provided by rebar, sometimes called "stirrups", bent in a form which generally conforms to the cross-section of the precast concrete structure.

2 Claims, 4 Drawing Sheets

(56) References Cited

U.S. PATENT DOCUMENTS

| | | | | |
|---|---|---|---|---|
| 5,605,413 | A * | 2/1997 | Brown | E01F 15/025 256/13.1 |
| 5,651,635 | A * | 7/1997 | Nagle | E01F 15/083 256/13.1 |
| 5,685,665 | A * | 11/1997 | Lembo | E01F 15/025 256/13.1 |
| 5,882,140 | A * | 3/1999 | Yodock, Jr. | E01F 15/083 256/13.1 |
| 6,679,649 | B1 | 1/2004 | Capolupo | |
| 6,851,887 | B2 * | 2/2005 | Lembo | E01F 15/088 404/6 |
| 7,185,882 | B2 * | 3/2007 | Buth | E01F 15/143 248/66 |
| 7,226,236 | B2 * | 6/2007 | Mertens | E01F 15/088 404/6 |
| 7,607,645 | B2 | 10/2009 | Smith | |
| 7,618,212 | B2 * | 11/2009 | Yodock, III | E01F 15/083 404/6 |
| 2003/0068199 | A1 | 4/2003 | Ulislam et al. | |
| 2003/0161683 | A1 * | 8/2003 | Lembo | E01F 15/088 404/6 |
| 2005/0152744 | A1 * | 7/2005 | Straub | E01F 15/083 404/6 |
| 2010/0301126 | A1 | 12/2010 | Meyer | |

* cited by examiner

INTERLOCKING HIGHWAY BARRIER STRUCTURE

BACKGROUND OF THE INVENTION

1. Field of the Invention

The present invention generally relates to a highway crash barrier structure for use in a highway barrier system capable of addressing current requirements for improving the crash performance of precast concrete barriers. The barrier system in which the crash barrier structure is used comprises a plurality of rigid sections disposed end-to-end in interlocking relationship with one another. The end of each section has a cavity and is provided with embedded interlocks that join with one another to hold the sections together. Individual sections can be removed or replaced without disrupting the remainder of the barrier system while maintaining proper alignment. The crash barrier structure of the present invention is provided with bolt down pockets which are reinforced with minimal steel yet meet MASH test requirements.

2. Background Description

In recent years, for controlling the flow of traffic, various barrier systems consisting of large sections of precast concrete have been used along highways. The sections can be hoisted into place and removed with greater speed and ease than is usually required to construct more permanent structures. Systems of this type can be dislodged when sufficient external force is applied, resulting in a potential traffic hazard. In some instances, the concrete sections are bolted together to maintain their alignment and assure that they will not be either knocked over or displaced by a colliding vehicle. However, such systems have the disadvantage of being complex and expensive and require considerable time and effort to assemble as well as to remove without disassembling the entire structure when used in road repairs.

Improvements in the system of bolted connections has been the use of looped steel bars that allow for a straight steel pin connection holding the adjoining loops together. This system is expensive and relies on maintaining the pins which also requires one's hands in a dangerous position between the barrier sections during placement or replacement. Vehicle impact on these systems usually requires significant time and expense to remove the pins.

U.S. Pat. No. 5,149,224 to Smith, which is herein incorporated by reference, shows an interlocking highway structure which employs a pair of "J" shaped hooks that connect separate concrete barrier members together without requiring extra hardware. In practice, the end of one precast concrete member is simply slid downward from the top such that the two adjoining precast concrete members have interlocking J connections. The product is commercially marketed as "JJ Hooks®". The "JJ Hooks®" product includes a short, approximately 12 inches in length, member to which rebar members are welded and extend inward into the precast concrete. While FIG. 3 of U.S. Pat. No. 5,149,224 shows the rebar extending only part way into the precast concrete, in practice the rebar can extend end-to-end with weldment of the rebar to both attachment hooks or can extend only part way into the precast concrete based on "pull out" strength/resistance.

U.S. Pat. No. 7,607,645 to Smith, which is herein incorporated by reference, addresses newer crash test criteria and to allow for greater use of the concrete barriers. These crash criteria are defined by the American Association of Highway & Traffic Officials (AASHTO's) Manual for Assessing Safety Hardware (MASH). The system disclosed in U.S. Pat. No. 7,607,645 is an interlocking barrier system that includes a plurality of rigid upright sections that can be joined together end-to-end using a "J" shaped connection member. The connection member preferably is embedded in a recessed cavity in each end of each section and has an outwardly projected hook. The connection member, as well as its associated hook and an outwardly projected receptacle flange, ran linearly along a line extending from the top to the bottom of each end of each section (e.g., 18") a distance which almost equals the height of each section. A plurality of bars (e.g., rebar) are welded or otherwise joined to the connection member and extend into the concrete section a distance that the minimum "pull out" strength resistance is met. In one embodiment, the rebar may extend end-to-end in the barrier structure. In another embodiment, the rebar do not traverse end-to-end distance of the section, and may extend two feet or more. This configuration eliminates or reduces the rotational forces imparted by a collision at one end of the section being imparted at the other end, thus making the interlocking structure more compliant with newer crash test safety requirements.

SUMMARY OF THE INVENTION

The present invention is an improvement in the "JJ Hooks®" barrier structure which provides bolt-down pockets, allowing the structure to be installed as a semi-permanent or permanent structure. The bolt-down pockets are at uniform spacing along the base of the barrier structure and located on opposite sides of the structure. A bolt-down bar may extend across and through the base at various pairs of bolt-down pockets. Additional reinforcement may be provided by rebar bent a generally "U" shape, sometimes called a "hairpin" shape. Toward each end of a bolt-down plate, the base of the "U" shaped rebar is located (and can be welded or otherwise secured if desired) near a bolt hole in the bolt-down plate with the legs of the "U" extending at an angle up into the concrete structure. Further reinforcing at the sites of the bolt-down pockets is provided by rebar, sometimes called "stirrups", bent in a form which generally conforms to the cross-section of the precast concrete structure. The structure minimizes the amount of steel used and still meets the MASH tests. In addition, the cost of fabrication is further reduced by requiring less labor to manufacture.

DESCRIPTION OF THE DRAWINGS

The foregoing and other objects, aspects and advantages will be better understood from the following detailed description of a preferred embodiment of the invention with reference to the drawings, in which.

DESCRIPTION

Figure 1:
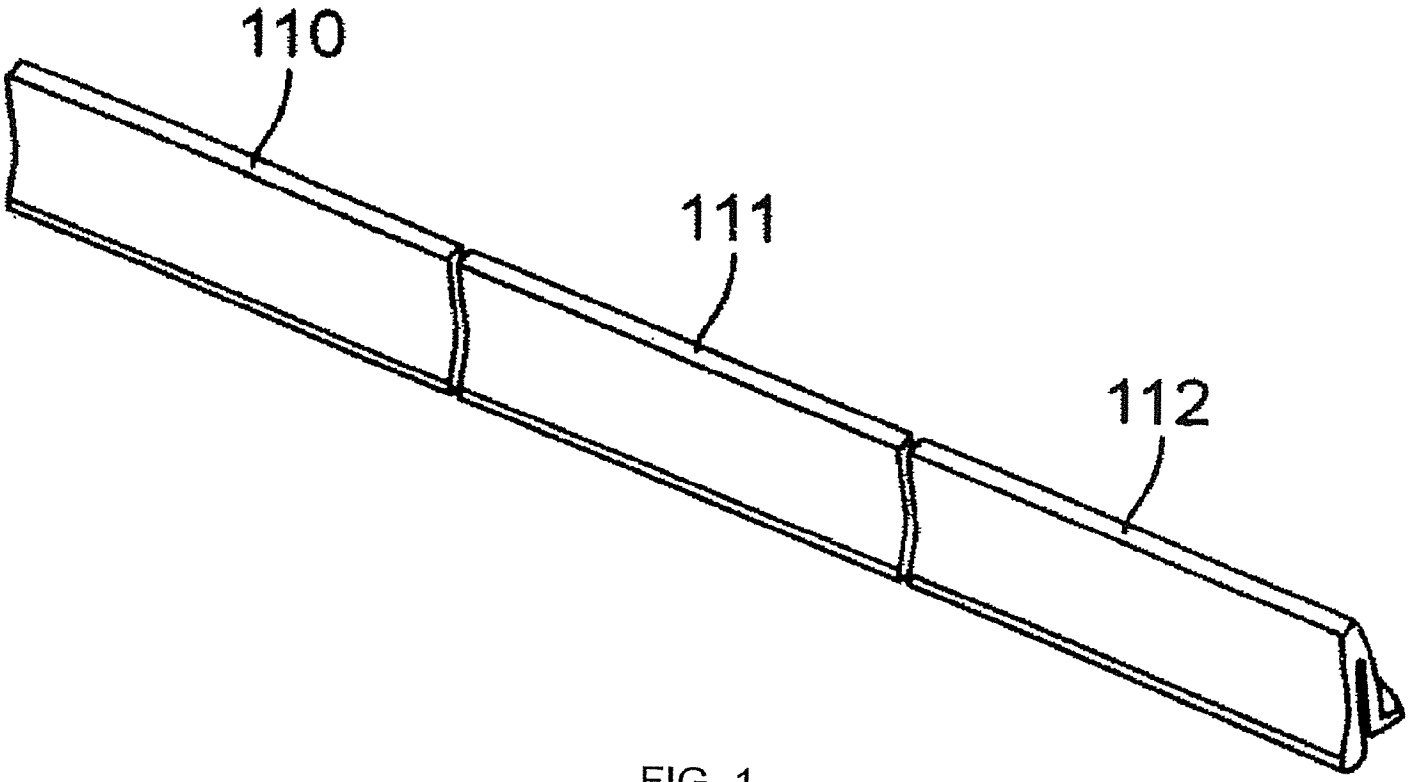
FIG. 1 is perspective view which shows the alignment of three interlocked barrier sections.

Referring now to the drawings, and more particularly to FIG. 1, there is shown, for exemplary purposes, three rigid upright sections 110, 111, and 112 linked end-to-end in alignment to fault a highway barrier system. An unlimited number of sections can be linked together and positioned to follow the path of a roadway (or perimeter of a building in the case of building protection application) as described more particularly in U.S. Pat. Nos. 5,149,224 and 6,607,645. Further, the outer shape and length of the upright sections 110, 111, and 112 can vary for different applications. In the preferred embodiment, each of the sections 110, 111, and 112 has a relatively wider base and tapers vertically to the top of the section. The invention can be used in road work as well as security and other applications.

Figure 2:
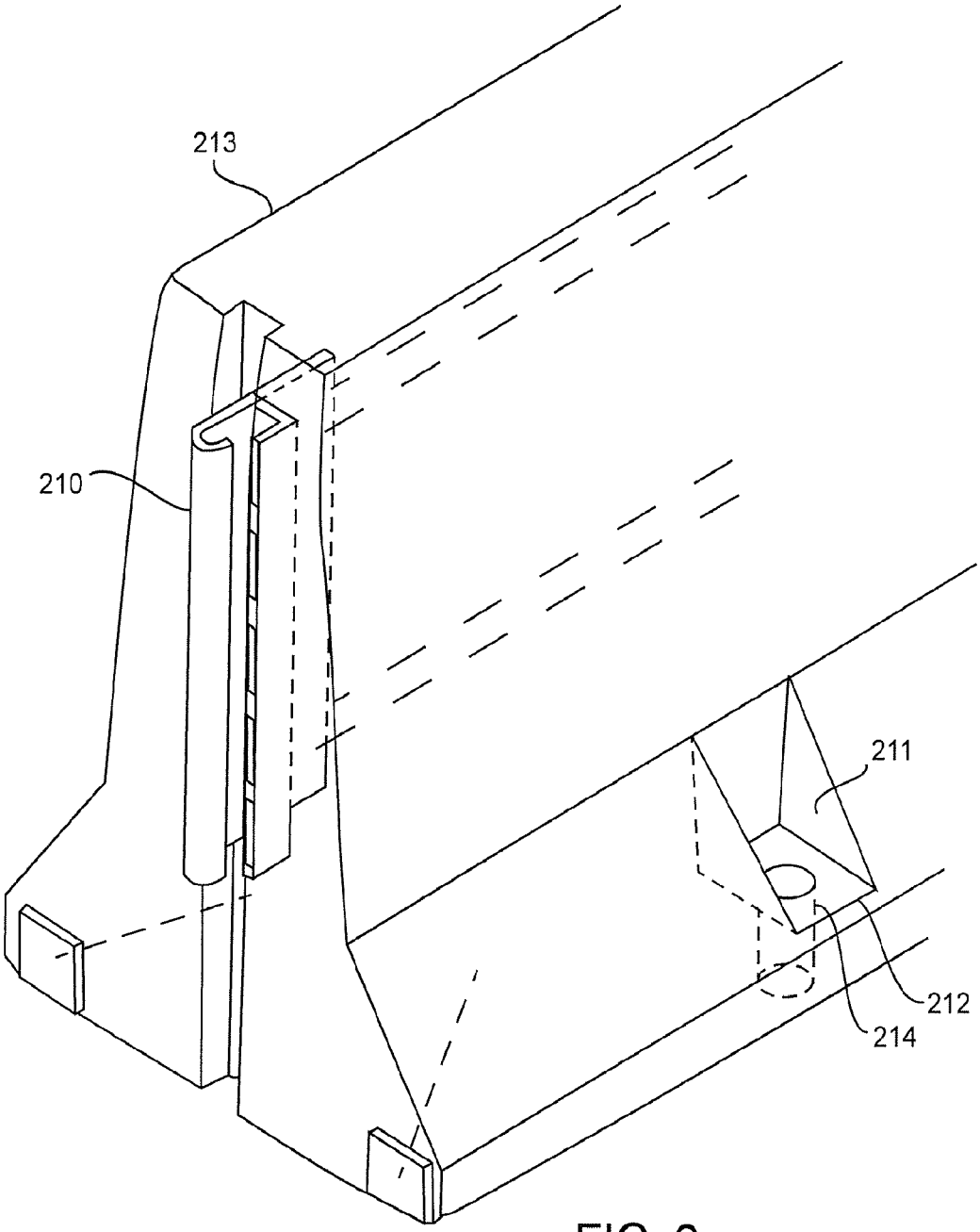
FIG. 2 is a perspective view of one end of the barrier structure of the present invention showing one of bolt-down pockets.
Figure 5:
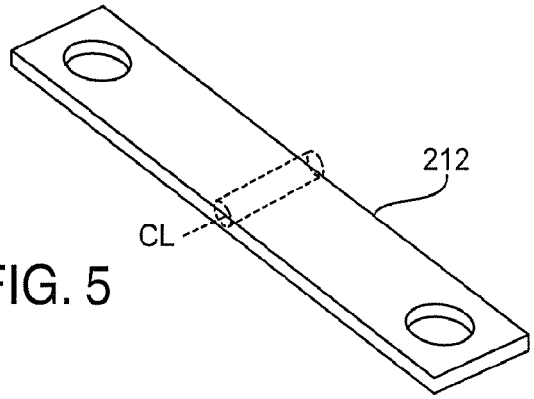
FIG. 5 is a perspective view of the bolt-down plate used in the barrier structure of FIGS. 3 and 4.

FIG. 2 shows in perspective view an end of one of the sections according to the present invention. As in the "JJ Hooks®" barrier structure of U.S. Pat. Nos. 5,149,224 and 6,607,645, the end of the structure is provided with a reinforced "J" hook 210 which interlocks with a corresponding "J" hook of an adjacent barrier section, as generally indicated in FIG. 1. The present invention provides bolt-down pockets, one of which is illustrated at 211, permitting semi-permanent or permanent installation of the barrier structure. Below the pocket 211 is an embedded bolt-down plate 212 which extends through the precast concrete structure 213 to a corresponding bolt-down pocket on the other side of the structure. The bolt-down plate is shown in perspective view in FIG. 5. A hole 214 extends downwardly through the plate 212 and the concrete structure 213 to allow for the passage of a bolt extending either up through the hole 214 and plate 212 from the surface below or down through the plate 212 and hole 214 to the surface below.

Figure 3:
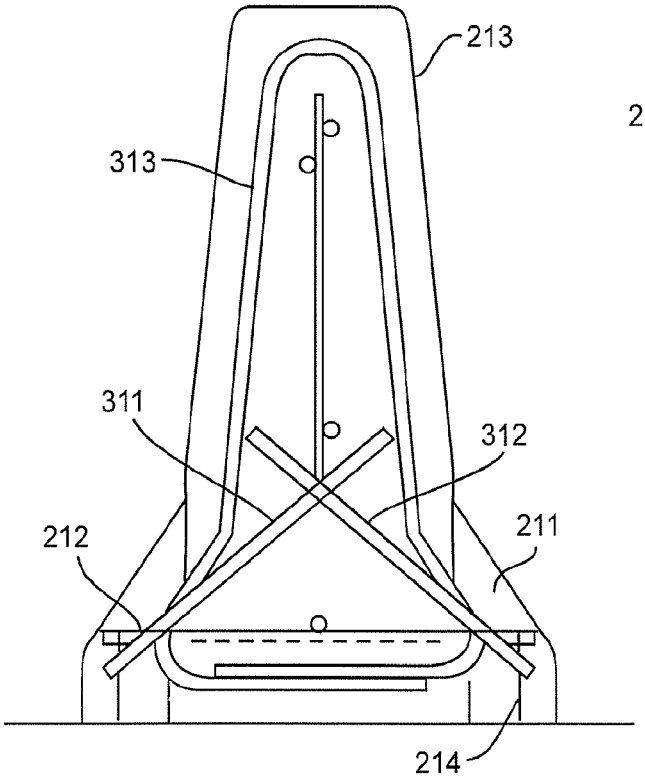
FIG. 3 is a cross-sectional view of the barrier structure at the location of a pair of bolt-down pockets showing the locations of the bolt-down plate and reinforcing "hairpin" and "stirrup" rebars.
Figure 6:
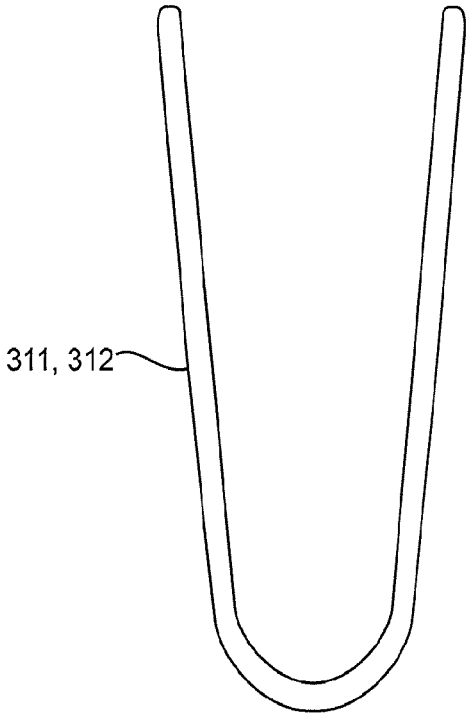
FIG. 6 is a plan view of the "hairpin" reinforcing rebar used in the barrier structure of FIGS. 3 and 4.

With such a structure, there is concern that a crash against the structure could cause the structure to crack at the locations of the bolt-down pockets or cause a shearing force of the bolts resulting in a failure of the structure in MASH tests. The present invention avoids these failures through reinforcement of the bolt-down plates and the precast concrete structure at the locations of the bolt-down pockets. As shown in FIG. 3, a pair of generally "U" shaped rebar rods 311 and 312, each having a shape shown in FIG. 6, is provided in the precast concrete structure. As may be appreciated from the general shape shown in FIG. 6, these rebar shapes are sometimes called "hairpins". Toward each end of each bolt-down plate 212, the base of the "U" shaped rebar is located near the bolt-down plate near a bolt hole in the bolt-down plate. The legs of the "U" shaped rods 311 and 312 extend at an angle up into the concrete structure 213. Further reinforcing at (e.g., directly adjacent, co-located with, or otherwise) the sites of the bolt-down pockets is provided by rebar 313, having a shape shown in FIG. 7. Because of its shape, the rebar 313 is sometimes called a "stirrup", since it is bent in a form which generally conforms to the cross-section of the precast concrete structure 213.

Figure 4:
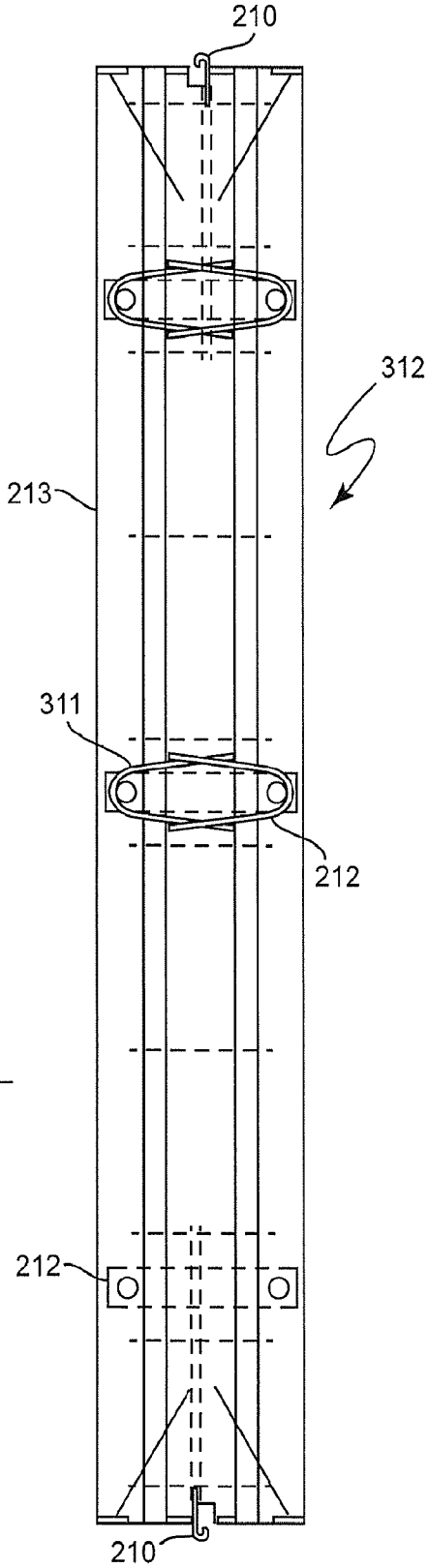
FIG. 4 is a plan view of the barrier structure showing the locations of bolt-down pockets and reinforcements.
Figure 7:
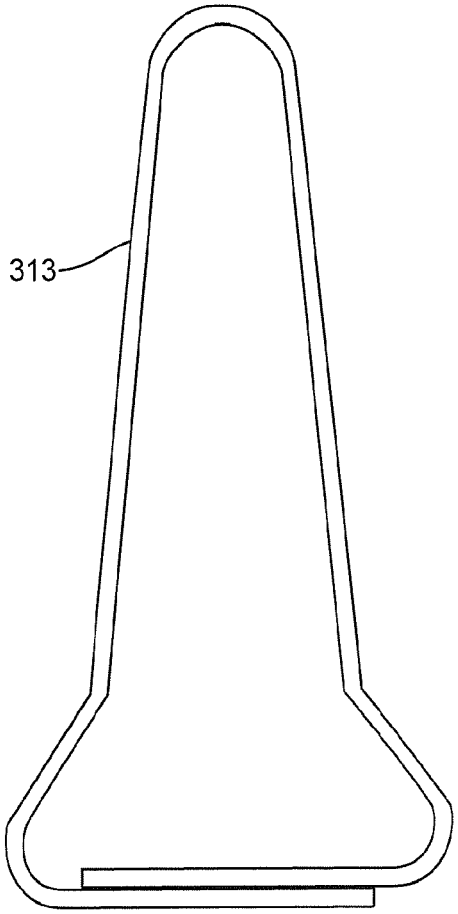
FIG. 7 is a plan view of the "stirrup" reinforcing rebar used in the barrier structure of FIGS. 3 and 4.

FIG. 4 shows a plan view of the barrier structure according to the invention. At each end of the structure are "J" hooks 210 oriented to mate with a corresponding "J" hook of an adjacent barrier structure. In the illustrated embodiment, there are three pairs of bolt-down pockets 211, two of which includes a bolt-down plate 212 extending through the concrete structure 213. Each bolt down pocket 211 is reinforced by a pair of "hairpin" rebar 311 and 312. Although not shown in this view, additional reinforcing may be provided at each location of bolt-down plates 212 by "stirrup" rebar 313, as shown in FIGS. 3 and 7. With the described design, for a 12 foot barrier, only two bolts are required, and as shown in FIG. 4 there are only two bolt down bars which saves costs. A twenty foot section may use either three or four bold down bars dependent on the location and number of pockets.

While the invention has been described in terms of a single preferred embodiment, those skilled in the art will recognize that the invention can be practiced with modification within the spirit and scope of the appended claims.

What is claimed is as follows:

1. An interlocking barrier structure for use in a barrier system in which sections are linkable end-to-end in an interlocking fashion, comprising:

a rigid precast concrete upright structure having a connection member embedded in each of a first and a second end, each said connection member having a hook member which projects outward from said first or said second end wherein said hook member extends linearly a given length along a line running from a top to a bottom of each rigid precast concrete upright structure;

the rigid precast concrete upright structure having a relatively wide base and tapering vertically, the base being provided with bolt-down pockets on opposite sides of the structure at uniform spacing along the base of the structure;

a plurality of bolt-down plates, each extending across and through the base of the structure at each pair of bolt-down pockets and comprising a bolt hole in each end; and "U" shaped reinforcement rebars, one for each end of a bolt-down plate, a base of each "U" shaped rebar being located near the bolt hole in each bolt-down plate with legs of the "U" extending at an angle up into the concrete structure, wherein each end of the bolt-down plate corresponds to a bolt-down pocket and the bolt-down plate extends from one bolt-down pocket through the base to the corresponding bolt down pocket on the other side of the structure.

2. The interlocking barrier structure recited in claim 1, further comprising reinforcing rebar at each of the sites of the bolt-down pockets, the reinforcing rebar being bent in a form which generally conforms to the cross-section of the rigid precast concrete upright structure.

* * * * *